United States Patent [19]

Mustin

[11] Patent Number: 4,468,028

[45] Date of Patent: Aug. 28, 1984

[54] PLAYING BOARD SIMULATING AN ACTION GAME

[75] Inventor: Frank H. Mustin, Lansdowne, Pa.

[73] Assignee: Fleer Corp., Philadelphia, Pa.

[21] Appl. No.: 568,580

[22] Filed: Jan. 6, 1984

[51] Int. Cl.[3] ..... A63F 3/00

[52] U.S. Cl. ..... 273/85 R; 273/240; 273/277; 273/139

[58] Field of Search ..... 273/139, 240, 277, 85 R, 273/93 R, 94

[56] References Cited

U.S. PATENT DOCUMENTS

| | | | |
|---|---|---|---|
| 2,109,603 | 3/1938 | Worth | 273/139 |
| 3,223,421 | 12/1965 | Hershkowitz | 273/139 |
| 3,826,499 | 7/1974 | Lenkoff | 273/240 |
| 3,941,386 | 3/1976 | Nelson | 273/85 R X |
| 4,095,824 | 6/1978 | Bachman | 273/139 X |

OTHER PUBLICATIONS

Hardee's Feast or Famine ©1976; Promotion West Inc.

*Primary Examiner*—Paul E. Shapiro

*Attorney, Agent, or Firm*—Dann, Dorfman, Herrell and Skillman

[57] ABSTRACT

A game board which simulates the play action of a team sporting event. The board is a representation of the playing area for the event and is divided into zones. Indicia spots are randomly arranged in each zone and are normally masked. During play, the spots are unmasked in sequence. The play moves from zone to zone, as determined by the indicia within the spot unmasked in the previous play, each indicia being coupled to a specific zone. Selected indicia indicate a goal is scored and selected indicia also indicate that a period of play is ended. The masking is preferably accomplished by a covering for the indicia spot which may be removed by peeling or by rubbing off.

11 Claims, 3 Drawing Figures

PLAYING BOARD SIMULATING AN ACTION GAME

FIELD OF THE INVENTION

The present invention relates to board games and more particularly to a board game having a playing area of the type used in a selected team sport contest, and with game movements simulating the action which normally occurs on the playing area represented on the board. In the preferred embodiment, the board is a single-use board which may be readily discarded when it is spent.

BACKGROUND OF THE INVENTION

In retailing it is common practice to provide game pieces with the purchase of merchandise. Commonly the game pieces include rub-off masks which are readily removed from the game piece in order to expose the question or the correct answer in games testing knowledge, or to expose the reward which results from the completion of the game in the case of games of chance.

In games played for amusement, the rub-off masks may cover alternate selections of paths which the player may follow in striving to reach a goal, with certain paths leading to an insurmountable barrier or a destruction area which causes the player to lose the game. Such game cards are called "maze-type" games since the player must follow one of two or more alternate pathways to progress through the playing of the game.

These conventional games tend to be repetitive and uninteresting since the only result is either successful completion of the game or unsuccessful termination.

SUMMARY OF THE INVENTION

With the foregoing in mind the present invention provides a board game of the stated type which permits simulation of team sporting contests played on a field or other arena in which the outcome is determined by the number of goals scored by each team. The invention enables a single board to provide a variety of results depending upon the skill and good fortune or misfortune of the player or players.

More specifically the present invention provides a game board having masked indicia spots which include a variety of indicia, some of which indicate scoring of a goal, some of which indicate termination of a playing period and still others of which provide for continuation of play without score, all of said spots being normally masked, but susceptible to unmasking at random.

In order to enhance the simulation of actual play, the present invention provides for different zones within the playing field or area along with a plurality of indicia spots in each zone, with the indicia spots in each zone being correlated to a zone so that the choice among indicia spots within a particular zone is comparable to the results which might be expected when a play occurs in such zone in the actual contest represented on the board.

Under the rules of play, the game proceeds from a starting zone in an unpredictable sequence of plays, back and forth, side to side, side to scoring zone, scoring zone to side, and so on, always providing one choice per zone, until a goal or period-ending goal indicia is uncovered. When play is directed to a given zone, the player selects any indicia spot therein and inactivates its mask revealing indicia that directs the next play to a new zone where the same selection and mask inactivation processes are repeated. The selected indicia may direct the player to choose one of two zones which may be in the other half of the game board.

Specifically the present invention provides a playing board having a plurality of zones with a multiplicity of indicia spots in each zone, the indicia of each indicia spot being coupled to one of said zones, at least one zone, and preferably two zones comprising a goal zone, there being at least one zone comprising a scoring zone for each goal zone, the indicia spots in each scoring zone including indicia coupled to the goal zone to represent a score, selected indicia spots throughout said zone indicating a termination of a playing period, so that unless such indicia spot is chosen, the play continues.

The present invention provides a game board which is inexpensive to produce yet which effectively simulates the play action of a selected team sporting contest.

BRIEF DESCRIPTION OF THE DRAWING

The foregoing objectives of the invention are more fully set forth hereinafter in the description of preferred embodiments of the invention which will be better understood when read in conjunction with the appended drawing in which.

DETAILED DESCRIPTION OF THE PREFERRED EMBODIMENT

Figure 1:
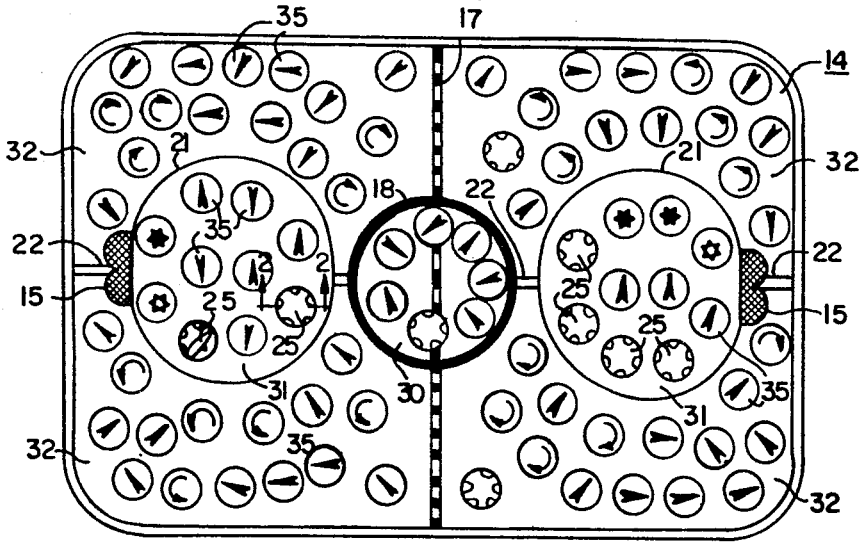
FIG. 1 is a plan view of a game board embodying the present invention with the cover means of most indicia spots removed for the purpose of illustration.

FIG. 1 illustrates a game board representing an ice hockey play area and the board consists of a substrate 14 having an ice hockey play area imprinted thereon. As shown, the play area includes goals 15 at opposite ends, the red line 17 which divides the play area into two equal parts and a face-off circle 18 centrally of the red line 17. The foregoing markings along with blue lines (not shown) are the conventional markings of a hockey rink. For the purpose of this board game, a scoring zone 31 is defined by a generally circular line 21 surrounding the front of the goal at each end, and a longitudinal center line 22 bisects the playing area.

For the purpose of playing the game on the board 14, the face-off circle 18 is used to define a starting zone 30 within the center of the area. The illustrations of the goals 15 define a goal zone. Likewise, the scoring lines 21 define scoring zones 31 at each end of the playing area. The red line 17 and the center line 22 divide the remaining area of the board into four quadrants, each comprising a scrimmage zone 32.

Figure 2:
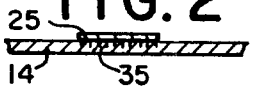
FIG. 2 is a sectional view through an indicia spot showing a removable masking means.

Within each of the zones except the goal zones, there are a plurality of indicia spots, each indicia spot being coupled to one or two of said playing zones. Each of the indicia spots is covered with a mask which in its active condition conceals the indicia in the spot, but can be inactivated so as to expose the indicia and indicate the zone in which the succeeding play is to occur. In the present instance, the mask for each indicia comprises a peel-off cover 25, as shown in the sectional view of FIG. 2. In the illustrated embodiment, the game board 14 is designed to be disposable after completion of a single game, and thus the cover 25 is normally destroyed when it is removed from the board. The removable masks may be peeled off or rubbed off. If it is desired to provide for repeated use of the same board, replaceable covers may be employed as masks, so that at the completion of the game, the covers may be replaced to render the board in condition for starting a first game. Alternatively, the board may be covered by a framework having individual doors which may be opened to expose the indicia of the spots underlying each door, the frame being common to a multiplicity of different boards in which the spots are arrayed the same, but the indicia are arranged in a different manner.

The game apparatus therefore comprises a playing board 14 having a play area with a plurality of zones 15, 30, 31 and 32. Within each of these zones except the goal zone, a plurality of indicia spots are provided with each spot being coupled to one or two of said zones, as described more fully hereinafter. Each indicia spot 35 has a mask 25 overlying the spot and in its active position being operable to cover the indicia of the spot. At the start of the game, all of the indicia of the spots are covered, and in the course of the game, the indicia of the spots are uncovered by inactivation of the mask means one-by-one until the game ends, the indicia which is unmasked being effective to direct the play to a zone which is coupled to said indicia.

By coupling the indicia of each spot to a particular one or two of the zones, the progress of the game simulates the play action in a team contest on a playing area comparable to that depicted on the game board.

For example the game board 14 depicts the playing area for an ice hockey contest. There are two goal zones 15. For the purpose of identification, the one at the left is designated the west goal zone and the one at the right is designated the east goal zone. There are four scrimmage zones 32 starting clockwise from the west goal: a northwest scrimmage zone, a northeast scrimmage zone, a southeast scrimmage zone, and a southwest scrimmage zone. In front of the west goal 15 is the west scoring zone 31 and in front of the east goal zone 15 is the east scoring zone 31. The face-off circle 18 defines the single starting zone 30.

Within the starting zone 30 are seven indicia spots, each spot having an arrowhead coupled to one of the scrimmage zones. Starting clockwise at the 12 o'clock position in this circle, the indicia in the first spot is coupled to the southwest scrimmage zone. The indicia in the next clockwise spot is coupled to the northeast scrimmage zone. The next spot is coupled to the southwest scrimmage zone. The next spot is coupled to the northwest scrimmage zone, the next spot (which is covered) is coupled to the southeast scrimmage zone, the next spot is coupled to the northwest scrimmage zone and the last spot is coupled to the southeast scrimmage zone. If it were desired to equalize the chances, an additional spot may be added to the center of the circle which would be coupled to the northeast scrimmage zone.

Under the rules of play, the game is started by the player selecting one indicia spot in the starting zone 30 and inactivating the mask to expose the indicia therein. The indicia is coupled to one of the scrimmage zones, and the next play must be selected by unmasking any one of the indicia spots in the coupled scrimmage zone. The game design is such that in the scrimmage zones it is possible to uncover three different indicia, each coupling the next play to different zones, either (a) the adjoining scoring zone, or (b) the adjoining scrimmage zone, or (c) either of the two scrimmage zones at the opposite end of the playing area. For example if the play is in the southwest scrimmage zone 32 the indicia in the spots 35 of the scrimmage zone 32 are coupled either to the adjoining scoring zone 31, to the adjoining northwest scrimmage zone, or to one or the other of the two eastern scrimmage zones (north or south). Referring to the southwest scrimmage zone, the indicia in the spots comprise five arrowheads pointing radially inward towards the scoring zone, five arrowheads pointing along the perimeter that lead the play around the back of the net and into the northwest scrimmage zone, and finally five reversing arrows pointing towards the eastern scrimmage zones. When a reversing arrow indicia is uncovered, the player must first select one of the two eastern scrimmage zones and then select from it the next indicia spot. If the uncovered indicia is coupled to any other scrimmage zone, the play continues in the same fashion in that zone.

When the indicia uncovered is coupled to a scoring zone, the player selects any one of the indicia spots in that scoring zone and inactivates the mask to expose the indicia. In the scoring zone, the indicia are divided among coupling to the adjoining scrimmage zones and the adjoining goal zone. The arrowheads shown in the indicia spots of FIG. 1 are coupled to the respective scrimmage zones on either side of the scoring zone, and the stars are coupled to the goal zone 15. It should be noted that there are stars of different character coupled to the goal zone, namely a solid star and a hollow star. The solid star represents a game-continuing goal whereas a hollow star represents a period-ending goal. If the game-continuing goal indicia is uncovered, the play continues with a new face-off in the starting zone and the team attacking that goal is awarded a point. If it is a period-ending goal, the team is awarded a point and the period ends. By the arrangement of indicia in the starting, scrimmage, and scoring zones, the progress of the game, as the indicia in the spots are uncovered, follows a normal pattern of play for a conventional ice hockey game.

In order to enhance the association with a conventional hockey game, the opposite goals may be identified with the names of rival hockey teams, and if desired the color scheme of the playing area may embody the team colors of the teams identified on the game board or card. The selection of scoring indicia in the two scoring zones and the particular distribution of scrimmage-zone indicia within the several zones may be varied to favor one team or the other, and may even be chosen in accordance with the relative strength of the teams identified on the board or card. Likewise the distribution of indicia throughout the board may be varied to a countless degree to change the odds. The invention provides a wide variety of action since the player may select any one of the unexposed indicia spots in the zones to which play is directed, and is permitted in some instances to select from two zones instead of the more common single-zone coupling.

In the illustrated ice hockey game, the game will end with the uncovering of a third period-ending goal-scoring indicia in the scoring zone, but there is a possibility that the game may end sooner by the exhaustion of the uncovered indicia spots in any zone to which play is directed. In such case, the score at the time of game end determines the winner. Thus there is a wide variety of endings which are available, as is the case when opposing teams are playing in a conventional ice hockey rink. With the arrangement of indicia shown in FIG. 1, although the mask 25 covers some indicia spots in each scoring zone 31, the distribution of indicia is such that there are two game-continuing-scores, two period-ending scores, three southward arrows, and three northward arrows. The winning team may score two to four goals before three periods end, whereas the losing team may score one, two or three goals before the three periods end. If the game ends because the indicia spots in one zone are exhausted, it is possible that neither team scores, although unlikely.

The present invention provides for a continuation of play which is comparable to the continual play which normally occurs in a hockey game. Preferably the number of spots and the distribution of indicia within the spots is selected so that in most cases there will be only a limited number of uncovered indicia spots in each zone when the game on the board is completed. It has been found that in boards with the arrangement shown in FIG. 1, where there are a maximum of seven goal opportunities between the two teams, there must be at least seven indicia spots in the starting zone. The distribution of indicia in the spots in a starting zone may provide equal opportunity to direct play in one direction or the other, or as shown, may favor play in one direction, the zone 30 having four spots heading in one direction and three spots heading in the other direction. In the scrimmage zone where there are 15 or 18 indicia spots, it is found that an equal mix of spots directed to the scoring zone, the attacking scrimmage zone, and the defending scrimmage zones provides a good mix of play. In the scoring zone where there are 10 indicia spots, a mix of three spots for the attacking scrimmage zone, three spots for the defending scrimmage zone and four goal zone spots provides a good mix. If additional goal indicia are desired, the number of indicia spots in the starting zone should be increased, since the number of indicia spots in the starting zone must be correlated to the number of goal indicia in the two scoring zones. Thus the present invention provides a simulated game in which the action may be sustained so as to utilize the major part of all of the indicia spots without experiencing a large number of games in which the indicia spots in any one zone are exhausted.

Figure 3:
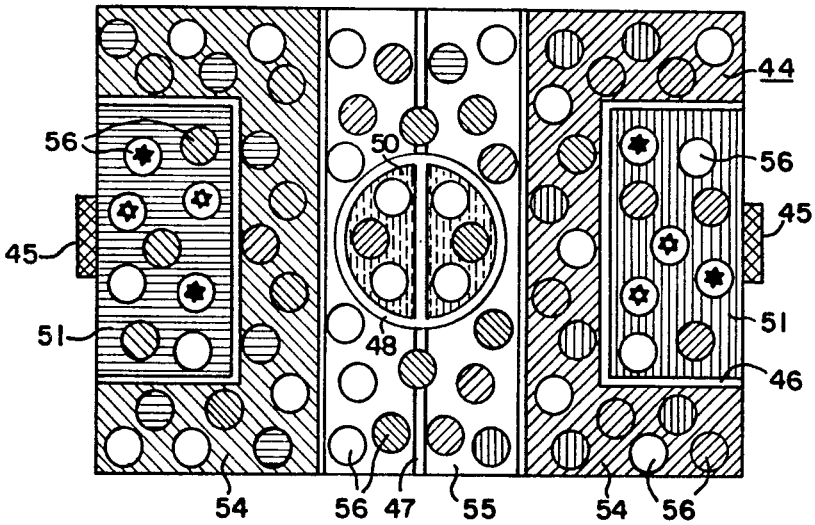
FIG. 3 is a view similar to FIG. 1 showing a different game board having indicia spots of a different character, all of the masking means being inactivated for the purpose of illustration.

FIG. 3 shows a game board representing a soccer field. In this board, the indicia within the spots are colors which are coupled to the corresponding background color in the various zones. The arrangement of the board in FIG. 3 simulates the action of a soccer game in which the soccer ball frequently traverses from one end of the field to the other and the use of colored indicia coupled with colored backgrounds in the respective zones permits play on the board to simulate the normal play action on a soccer field.

Referring now to FIG. 3, the soccer board 44 includes goal zones 45 at the west and east end. A scoring zone 51 defined by the 12-yard mark 46. A mid-field stripe 47 divides the field into east and west halves, but for the purposes of the game, each half is separated into an attack scrimmage zone 54 and a neutral scrimmage zone 55, the latter of which extends on either side of the mid-field stripe 47. A kick-off circle 48 defines a starting zone 50. Each of the zones, except the goal zones 45, includes a plurality of indicia spots 56 to direct the play from that zone. As in the embodiment of FIG. 1, each of the indicia spots is masked with a suitable masking means which in its active position covers the indicia within the spot 56. The masking means is not shown in FIG. 3, but it may correspond to the masking means 25 shown in FIGS. 1 and 2, or may be of another variety.

The arrangement of the indicia in the game of FIG. 3 provides a play action which simulates the action in soccer. For example in the scoring zone, the indicia in the spots 56 are divided among indicia which are coupled to the goal zone, the adjoining attack scrimmage zone 54 and the neutral scrimmage zone 55 so that a shot into the scoring zone may be returned to the neutral scrimmage zone 55, mid-field area, as is often the case in a soccer game. In the attack scrimmage zone, the indicia may direct the next shot into the opposite attack scrimmage zone, the neutral scrimmage zone, within the same zone, or into the adjoining scoring zone. In the neutral scrimmage zone, the indicia provide for the next shot to be within the same neutral scrimmage zone, in the adjoining attack scrimmage zones, and also enable a shot to be directed into the opposite scoring zones. Thus the sequence of shots in the game of FIG. 3 corresponds to an average flow of play action in a soccer game. The goal-scoring indicia in the scoring zones are divided among period-ending and non-period-ending scores, as was the case in the game of FIG. 1, and the number of goal indicia is correlated to the number of spots in the starting zone.

Thus the use of indicia within the indicia spots coupled to the indicia in the background of the respective zones affords a high degree of selectivity and a countless arrangement of indicia.

In both of the hockey and soccer embodiments of the invention, the board may be played by one or two players. If two players play the game, each player chooses one of the two teams designated in contest on the particular game board in use, and then makes all the plays in his opponent's half of the game board. If one person plays alone, after choosing the team he favors to win, he makes all the plays himself. In either of the two preceeding methods of play each game board will provide the one or two players with the entertainment of simulating a real game with all of the ups and downs of intermediate goals and excitement of a multi-period game which will end in a win, loss or tie score depending on the team selection and spot selections made by the one or two players.

If it is desired to shorten the game, the rules may provide that the uncovering of the first period-ending goal indicia ends the game. Alternatively the board may provide additional special period-ending indicia, not coupled to goals, in other zones on the game board. The number of periods may be set to correspond to the number of periods in the game being simulated by the board. For example, when play area is an ice hockey rink, there are three periods in the game, whereas when playing area represents a soccer field, there are two periods in the game. In the case of a tie game, the rules may provide a sudden-death overtime period.

In accordance with the invention, the game board is susceptible of mass production in a very economical fashion since the indicia may be imprinted on the boards by standard imprinting techniques and the masking of the indicia spots may likewise be accomplished in conjunction with the printing operation. The instructions for playing the game are simple and may be printed on the reverse side of the game board so that the boards may be produced in mass in a countless variety of layouts, and collated for distribution in a pack so that there is no repetition within the pack. It is contemplated that the boards will be assembled in packs of three, five, seven or nine, to simulate a play-off or a championship series, but any grouping may be selected. The economical production of the game boards does not detract from the interest which each game may generate since the arrangement wherein each indicia spot is coupled to a particular zone provides an intricate play-action game which is easily understood and yet is sufficiently interesting to occupy the attention of adults as well as children. As the game becomes more familiar to the players, additional variations may be incorporated into the rules of the game so as to increase its intricacy.

The invention is not limited to the printed version discussed above, but may be used in conjunction with other apparatus where a more permanent arrangement is desired. As indicated in the discussion of the masking means, the masking means may be embodied in a frame which is designed to accommodate different boards and the selection of the boards is effective to alter either the distribution of indicia within the indicia spots or may also be designed to alter the type of game represented on the board. If the distribution of indicia spots is the same for game boards representing different goal-scoring team sports, the same frame may be used for multiple sports.

The particular form of the masking means may be selected to accommodate different capabilities and different types of use. For example, the mask means may comprise a plastic sheet overlying the board and provided with opaque portions overlying at least each of the indicia spots. The opaque portions in their normally active position are effective to cover the indicia within the spots, but the plastic sheet is designed to become translucent or transparent upon inactivation, for example by the application of local pressure, by the application of a drop of water or other chemical, or by some other technique. In such case the inactivation of the opaque sheet will expose the indicia to indicate the direction of further play.

It should be understood that the invention is not limited to representation of team contests, but with modification the board may be designed to simulate other play action, for example foul shooting wherein only one goal zone is provided and the scoring zone would provide indicia which would indicate a goal scored, or a goal missed with resumption of play in a scrimmage zone.

Other variations will be apparent to those in the field. Thus while particular embodiments of the present invention have been herein illustrated and described, the invention is not limited to such disclosure, but changes and modifications may be made therein and thereto within the scope of the following claims.

I claim:

1. A playing board apparatus comprising a play area having a plurality of zones, one of said zones being a starting zone, at least two of said zones being goal zones, at least two zones being scoring zones, each of said scoring zones being adjacent a separate goal zone, and at least two zones being scrimmage zones, a plurality of indicia spots in each of said zones except the goal zones, and mask means overlying each spot and in its active condition covering the indicia of the spot, the starting zone having spots with indicia each coupled to a separate one of said two scrimmage zones, the scoring zone having selected spots with indicia coupled to the first scrimmage zone, selected spots with indicia coupled to the second scrimmage zone, and selected spots with indicia coupled to the adjacent goal zone representing a score, said mask means being capable of inactivation to expose the indicia of a single spot.

2. A playing board apparatus according to claim 1 wherein said indicia in the spots comprise directional arrows pointing toward the zone to which said indicia is coupled.

3. A playing board apparatus according to claim 1 wherein each of said zones has a unique color background and the indicia in each spot comprises a color corresponding to the color of the zone to which it is coupled.

4. A playing board apparatus according to claim 1 wherein said mask means comprises a cover element overlying the indicia spot, the mask means being inactivated by removal of the cover element.

5. A playing board apparatus according to claim 4 wherein said cover element is capable of being peeled from said indicia spot.

6. A playing board apparatus according to claim 4 wherein said cover element is capable of being removed from said indicia spot by rubbing.

7. A playing board apparatus according to claim 1 wherein selected indicia spots include period-ending indicia designating an interruption in play.

8. A playing board apparatus according to claim 7 wherein said selected indicia spots having period-ending indicia are coupled to said goal zones.

9. A playing board apparatus according to claim 1 wherein the number of indicia spots in the starting zone is correlated to the number of selected spots with indicia coupled to a goal zone.

10. A playing board apparatus according to claim 1 wherein the distribution of different indicia within the spots of each zone is selected to provide the desired odds for favoring either a tie score, or a final score favoring one team or the other.

11. A playing board apparatus comprising a play area having a plurality of zones, including a goal zone, a scoring zone and a scrimmage zone, a plurality of indicia spots in each of said zones except the goal zone, and mask means overlying each spot and in its active condition covering the indicia of the spot, selected spots in said scoring zone being coupled to said goal zone, other selected spots in said scoring zone being coupled to the scrimmage zone, the scrimmage zone having selected spots with indicia coupled to said scoring zone and selected spots with indicia coupled to said scrimmage zone, said mask means being capable of inactivation to expose the indicia of a single spot.

* * * * *